US011346509B1

(12) United States Patent
Wu

(10) Patent No.: US 11,346,509 B1
(45) Date of Patent: May 31, 2022

(54) WATERPROOF LED LAMP

(71) Applicant: Jinjiang Wonderful Photoelectric Lighting Co., Ltd., Fujian (CN)

(72) Inventor: Qingbiao Wu, Fujian (CN)

( * ) Notice: Subject to any disclaimer, the term of this patent is extended or adjusted under 35 U.S.C. 154(b) by 0 days.

(21) Appl. No.: 17/396,748

(22) Filed: Aug. 8, 2021

(30) Foreign Application Priority Data

Jul. 23, 2021 (CN) ..... 202121695930.5

(51) Int. Cl.

| | |
|---|---|
| ***F21K 9/232*** | (2016.01) |
| ***F21V 31/00*** | (2006.01) |
| ***F21V 19/00*** | (2006.01) |
| ***F21V 3/06*** | (2018.01) |
| *F21W 131/10* | (2006.01) |
| *F21Y 115/10* | (2016.01) |

(52) U.S. Cl.
CPC ..... *F21K 9/232* (2016.08); *F21V 3/0625* (2018.02); *F21V 19/003* (2013.01); *F21V 31/005* (2013.01); *F21W 2131/10* (2013.01); *F21Y 2115/10* (2016.08)

(58) Field of Classification Search
CPC ..... F21K 9/232; F21V 31/005; F21V 19/003; F21W 2131/10
See application file for complete search history.

(56) References Cited

U.S. PATENT DOCUMENTS

2009/0251923 A1* 10/2009 Yu ..... F21V 31/005 362/653
2018/0128447 A1* 5/2018 Chen ..... F21V 17/12
2019/0353309 A1* 11/2019 Yu ..... H01R 33/09

* cited by examiner

*Primary Examiner* — Karabi Guharay
(74) *Attorney, Agent, or Firm* — Prakash Nama; Global IP Services, PLLC

(57) ABSTRACT

This invention discloses an LED lamp including a lampshade, a lamp cap, a light source device and electronic components; the lampshade includes a cover body and a mounting part; a lamp post cover is provided in the mounting part with interference fit; a lamp post is provided at the lamp post cover with interference fit; the electronic components are installed on the lamp post, and the light source device is installed between the lamp post and the lamp post cover. By positioning the light source device between the lamp post cover and the lamp post, and by pressing the lamp post cover and the lamp post into the mounting part of the lampshade, a good seal is formed among the lamp post cover, the lamp post and the lampshade, thereby effectively improving the waterproof level of the lamp.

6 Claims, 3 Drawing Sheets

WATERPROOF LED LAMP

BACKGROUND OF THE INVENTION

The present invention relates to the technical field of lighting, in particular to an LED lamp.

With the development of economy and society and the improvement of lighting equipment technology, lamps have been more and more widely used in people's daily life as well as in various outdoor occasions, such as outdoor landscape lighting, illumination lighting and large-scale building lighting.

In order to solve the problem that outdoor lighting lamps are easily damaged by rainwater, in the prior art, generally the socket of the lamp is sealed, that is, through the interference fit between the mounting part and the lamp post, the lamp post is pressed into the mounting part of the lampshade at the same time, and a good seal is formed between the lamp post and the lampshade, so that the light source device and electronic components installed in the lampshade have a good waterproof effect, which effectively improves the waterproof level of the lamp. However, in order to comply with the UL standard, that is, the human body cannot directly touch the electronic components, usually in the prior art, a PC lampshade is used. When the electronic components and lamp posts are placed in the lampshade, the PC lampshade could pass the cold smashing test. In a cold smashing test during UL testing, the product is cooled at low temperature such as −20° C. for a certain period of time, and the product is then smashed by another object; if the product is not damaged, the product passes the cold smashing test; if the product is damaged but it is impossible for the human body to directly touch the electric components, the product also passes the cold smashing test. However, because the PC material is too expensive, it will greatly increase the cost, which is not in line with economic benefits. If an ordinary transparent plastic lampshade is used, although the material is cheaper, the ordinary transparent plastic lampshade shatters during cold smashing test, resulting in direct contact with the circuit part and causing an electric shock. Therefore, the ordinary transparent plastic lampshade cannot pass the cold smashing test.

In view of this, the inventor conducted in-depth research on the problems mentioned above, thus resulting in the present invention.

BRIEF SUMMARY OF THE INVENTION

The object of the present invention is to provide an LED lamp with a simple structure and low cost, and complies with the UL standard.

To attain this, the present invention adopts the following technical solution: An LED lamp comprising a lampshade, a lamp cap connected with the lampshade, and a light source device and electronic components located in the lampshade and electrically connected to each other; the lampshade comprises a cover body and a mounting part integrally connected to the cover body; the mounting part is inserted into the lamp cap; a lamp post cover is provided in the mounting part with interference fit; the lamp post cover has an opening at a first end thereof which is close to the lamp cap; a lamp post is provided at the opening with interference fit; the electronic components are installed on the lamp post, and the light source device is installed between the lamp post and the lamp post cover.

As a preferred embodiment of the present invention, the lamp post is provided with through-holes for the electronic components to pass through, and the through-holes penetrate from a first side of the lamp post to a second side of the lamp post.

As a preferred embodiment of the present invention, the lamp post cover has an outer diameter which gradually decreases from the first end thereof which is close to the lamp cap to a second end thereof which is away from the lamp cap; the lamp post has an outer diameter which gradually decreases from a first end thereof which is close to the lamp cap to a second end thereof which is away from the lamp cap.

As a preferred embodiment of the present invention, the lamp post cover is a light-transmitting lamp post cover, and the lampshade is a light-transmitting lampshade.

As a preferred embodiment of the present invention, the lamp post cover is made of PC material, and the lampshade is made of ordinary transparent plastic material.

As a preferred embodiment of the present invention, the light source device comprises a PCB board; the PCB board is installed between the lamp post and the lamp post cover, and at least one LED is pasted or welded on a side of the PCB board which faces the cover body.

By adopting the aforementioned design scheme, the beneficial effects of the present invention are as follows: With the interference fit between the mounting part and the lamp post cover, the interference fit between the lamp post cover and the lamp post, the positioning of the light source device between the lamp post cover and the lamp post, and by pressing the lamp post cover and the lamp post into the mounting part of the lampshade, a good seal is formed among the lamp post cover, the lamp post and the lampshade, so that the light source device installed in the lampshade has a good waterproof effect, thereby effectively improving the waterproof level of the lamp. The lamp post cover of the present invention conforms to the UL standard. When the lampshade shatters, the lamp post cover will cover the electronic components and the light source device to prevent the human body from directly touching the power supply part, thus fulfilling certification and testing requirements for UL standard.

In the figures: 1 denotes the lampshade, 11 denotes the cover body, 12 denotes the mounting part, 13 denotes the inner hole, 2 denotes the lamp cap, 3 denotes the PCB board, 4 denotes the LED, 5 denotes the lamp post cover, 51 denotes the first surface, 52 denotes the first annular side wall, 53 denotes the first accommodating space, 6 denotes the lamp post, 61 denotes the second surface, 611 denotes the first through-hole, 612 denotes the second through-hole, 613 denotes the clamping part, 62 denotes the second annular side wall, 63 denotes the second accommodating space, 71 denotes the first electronic component, 711 denotes the first electric connection terminal, 712 denotes the first connection terminal, 72 denotes the second electronic component, 721 denotes the second electric connection terminal, 722 denotes the second connection terminal, 73 denotes the third electronic component, 8 denotes the glue.

DETAILED DESCRIPTION OF THE INVENTION

The following clearly and completely describes the technical solutions in the embodiments of the present invention in conjunction with the accompanying drawings. Obviously, the described embodiments are only a part of the embodiments of the present invention, rather than all embodiments. Based on the embodiments of the present invention, all other embodiments obtained by ordinary technical personnel of this field without creative work shall fall within the protection scope of the present invention.

Figure 1:
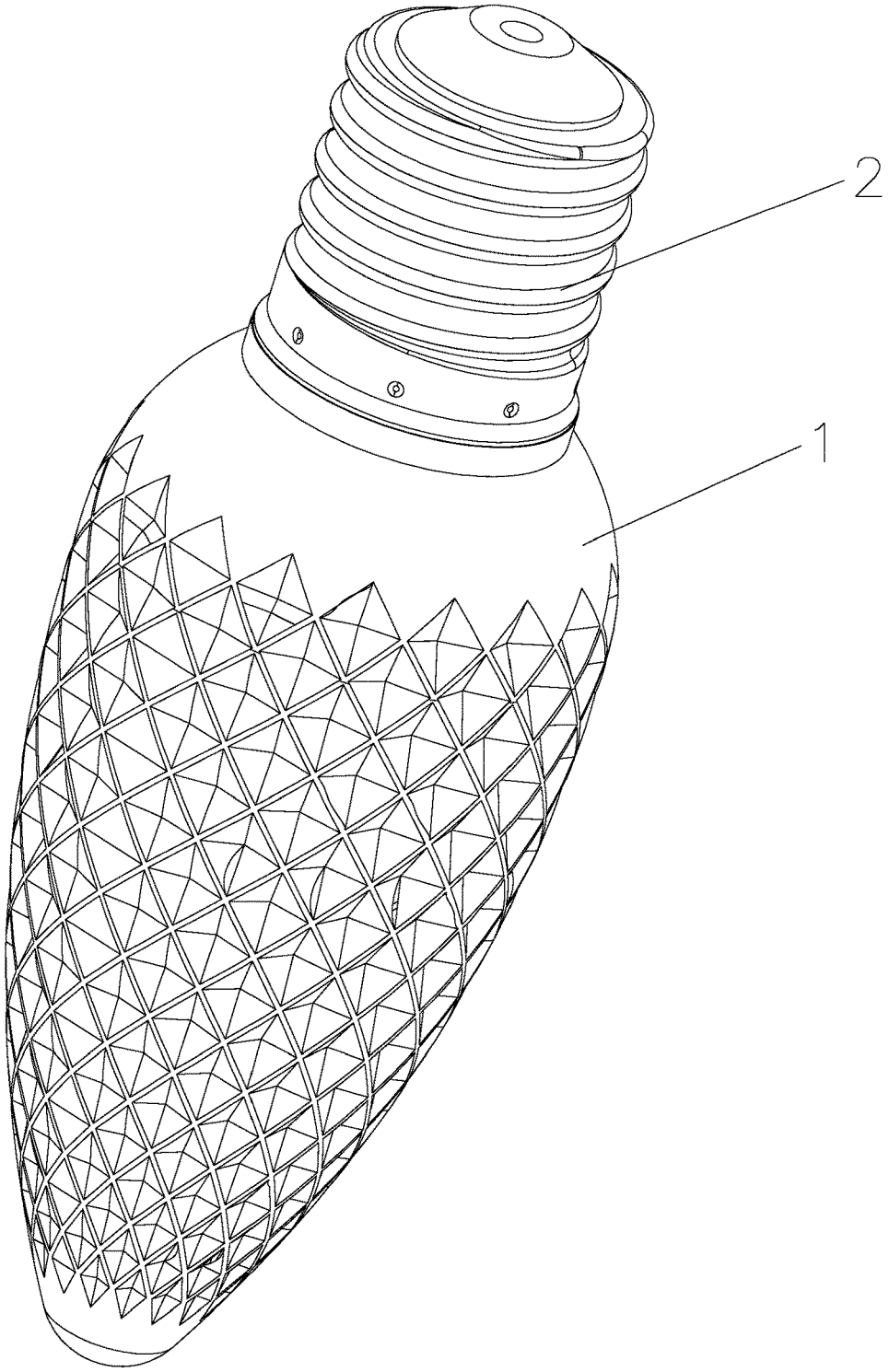
FIG. 1 is a schematic view of the structure of the present invention.
Figure 2:
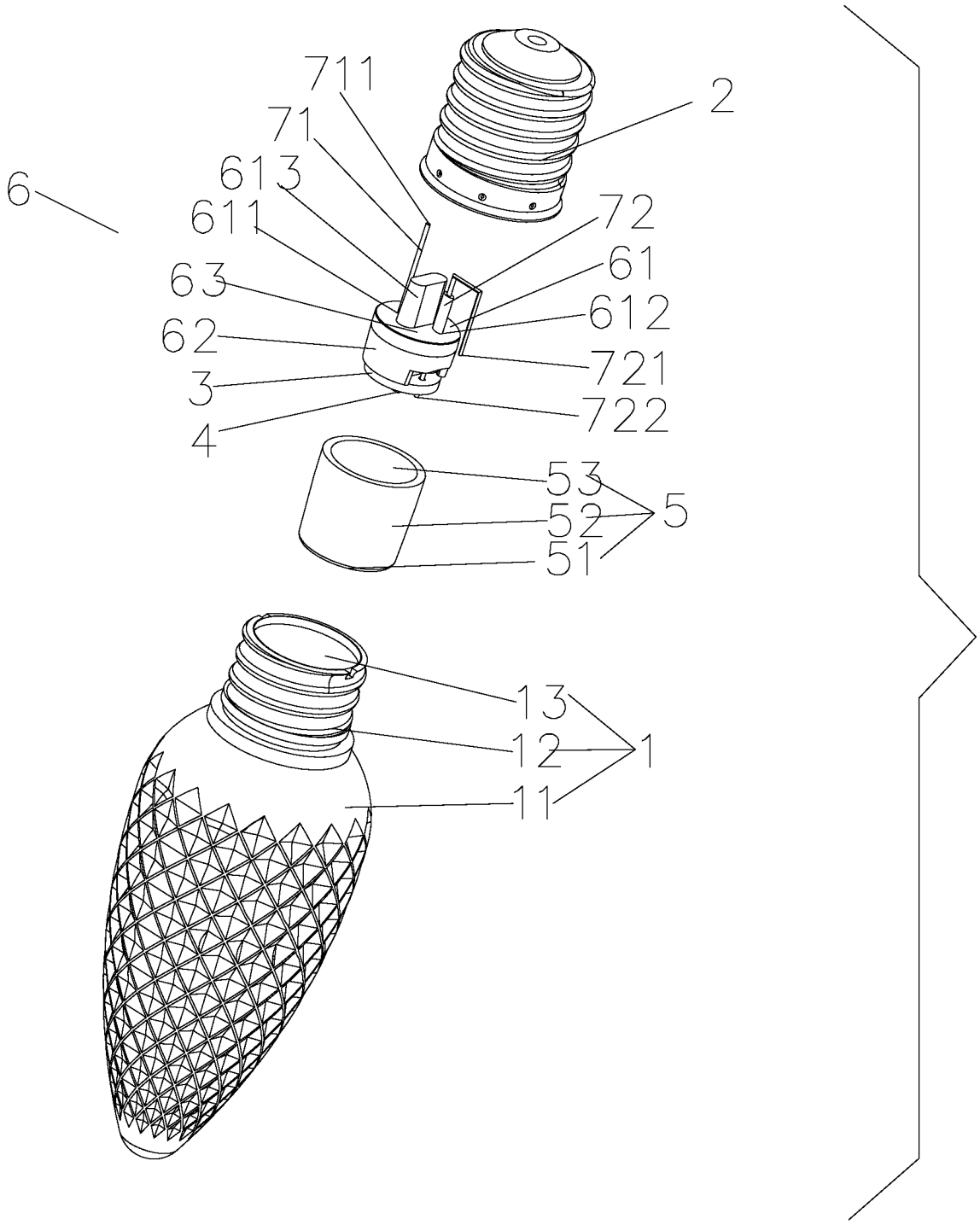
FIG. 2 is a dissembled view of the present invention.
Figure 3:
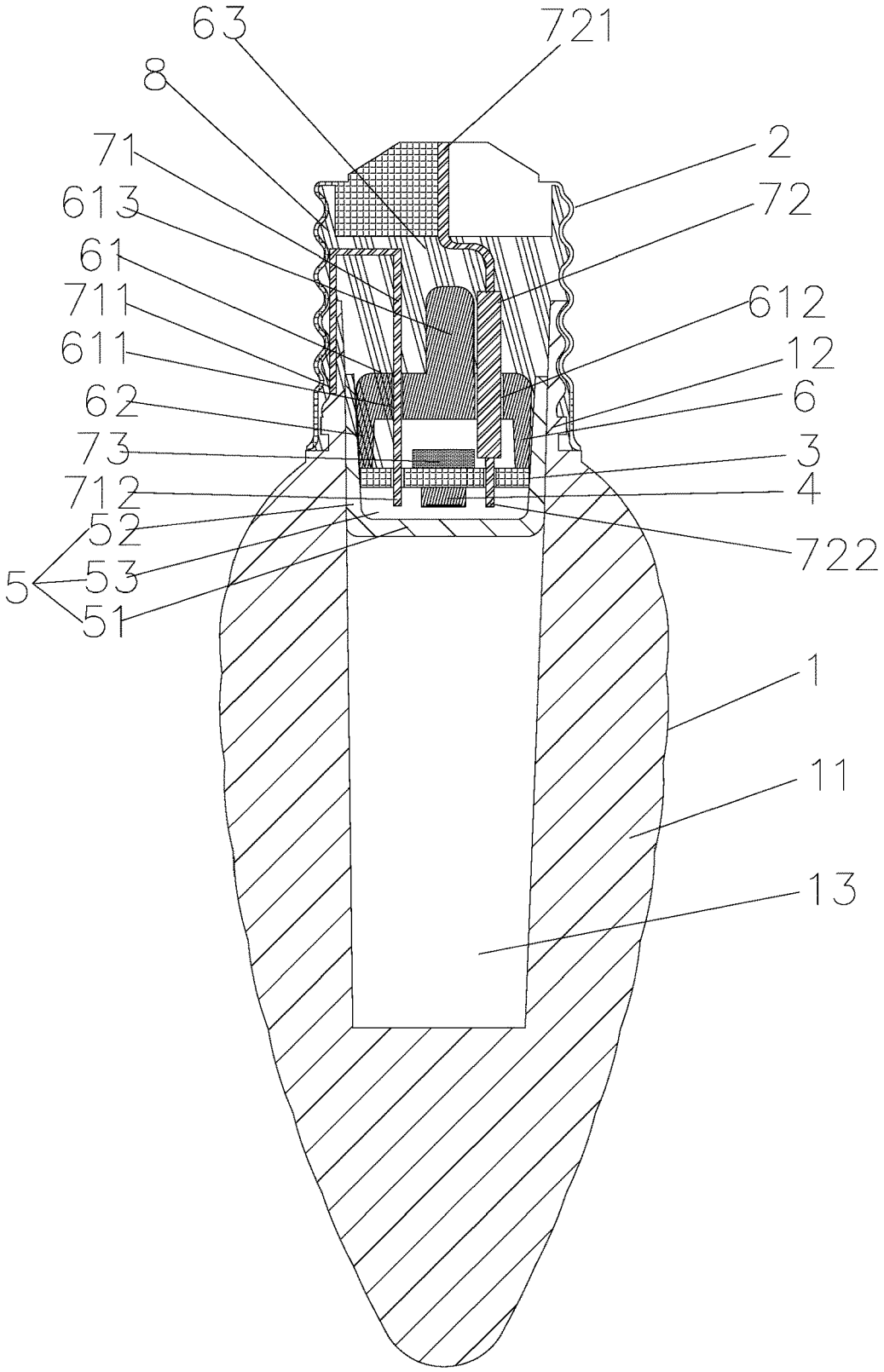
FIG. 3 is a cross-sectional view of the present invention.

Please refer to FIG. 1 to FIG. 3.

An LED lamp comprises a lampshade 1, a lamp cap 2 connected with the lampshade 1, and electronic components and a light source device located in the lampshade 1 and electrically connected to each other. The lampshade 1 is made of ordinary transparent plastic material and is a light-transmitting plastic lampshade.

The lampshade 1 comprises a cover body 11 and a mounting part 12 integrally connected to the cover body 11. The mounting part 12 is inserted into the lamp cap 2. The mounting part 12 has an inner hole 13 for connecting an inner cavity of the cover body 11 with an exterior space of the cover body 11. The light source device is installed in the inner hole 13.

The light source device comprises a PCB board 3, and at least one LED 4 is pasted or welded on a side of the PCB board 3 which faces the inner hole 13.

A lamp post cover 5 is provided in the mounting part 12 with interference fit. The lamp post cover 5 is integrally injection molded. The lamp post cover 5 is made of PC material and is a light-transmitting plastic lamp post cover. The lamp post cover 5 comprises a first surface 51 and a first annular side wall 52 standing on the first surface 51. The first surface 51 and the first annular side wall 52 enclose a first accommodating space 53 which has an opening at one end and accommodates a lamp post 6 (which will be introduced in detail below), the PCB board 3, the LED 4 and the electronic components. Specifically, the lamp post cover 5 has an outer diameter which gradually decreases from a first end thereof which is close to the lamp cap 2 to a second end thereof which is away from the lamp cap 2, and the outer diameter of the lamp post cover 5 at the first end where the opening is located is slightly larger than an inner diameter of the mounting part 12, so as to realize the interference fit between the lamp post cover 5 and the mounting part 12. In this embodiment, the PC lamp post cover 5 is in compliance with UL standard; when the lampshade 1 shatters, the lamp post cover 5 will cover the PCB board 3, the LED 4 and the electronic components, thereby preventing the human body from directly touching the power supply part and causing an electric shock after the lampshade 1 shatters. This fulfills certification and testing requirements for UL standard.

A lamp post 6 is provided at the opening of the lamp post cover 5 with interference fit, and the PCB board 3 and the LED 4 are both installed between the lamp post 6 and the lamp post cover 5. With the interference fit between the lamp post 6 and the lamp post cover 5, and that the lamp post 6 is pressed into the first accommodating space 53 of the lamp post cover 5, a good seal is formed between the lamp post 6 and the lamp post cover 5, so that portions of the electronic components, the PCB board 3 and the LED 4 disposed between the two have good waterproof effect, thereby effectively improving the waterproof level of the lamp.

The electronic components comprise a first electronic component 71, a second electronic component 72, and a third electronic component 73. The first electronic component 71 comprises a first electric connection terminal 711 electrically connected to a power source and a first connection terminal 712 electrically connected to the PCB board 3. The second electronic component 72 comprises a second electric connection terminal 721 electrically connected to the power source and a second connection terminal 722 electrically connected to the PCB board 3. The third electronic component 73 is installed on the PCB board 3 and is electrically connected to the PCB board 3. It is worth noting that the third electronic component 73 in this embodiment can adopt a bridge rectifier stack conventionally used on the market. The first electric connection terminal 711 can be connected to the live wire of the mains electricity, and the second electric connection terminal 721 can be connected to the neutral wire of the mains electricity.

The lamp post 6 is formed by injection molding. The lamp post 6 comprises a second surface 61 and a second annular side wall 62 standing on the second surface 61. The second annular side wall 62 and the second surface 61 enclose a frame with one side open. A first through-hole 611 and a second through-hole 612 are symmetrically opened on the second surface 61, and both the first through-hole 611 and the second through-hole 612 penetrate from a first side of the second surface 61 to a second side of the second surface 61. The first electronic component 71 passes through the first through-hole 611 and is installed in the first through-hole 611, and the second electronic component 72 passes through the second through-hole 612 and is installed in the second through-hole 612.

The second annular side wall 62 has an outer diameter which gradually decreases from a first end thereof where the second annular side wall 62 is connected with the second surface 61 to a second end thereof; the outer diameter of the second annular side wall 62 at the first end thereof where the second annular side wall 62 is connected with the second surface 61 is slightly larger than the outer diameter at the opening of the lamp post cover 5, so as to realize the interference fit between the lamp post 6 and the lamp post cover 5. The lamp post 6 is a flame-retardant and fireproof plastic lamp post, which helps to improve the heat dissipation of the lamp, so that the heat generated by the first electronic component 71, the second electronic component 72, the PCB board 3 and the LED 4 during operation can be dissipated in time, thereby effectively improving the service life of the lamp.

In the present invention, with the interference fit between the lamp post 6 and the lamp post cover 5, a good seal is formed between the lamp post 6 and the lamp post cover 5, which leads to a good waterproof effect for the first electronic component 71, the second electronic component 72, the third electronic component 73, the PCB board 3 and the LED 4 installed in the lamp post 6 and lamp post cover 5. With the interference fit between the lamp post cover 5 and the mounting part 12, a good seal is formed between the lamp post cover 5 and the mounting part 12, which leads to a good waterproof effect for portions of the first electronic component 71 and the second electronic component 72 exposed outside the lamp post 6, thereby effectively improving the waterproof level of the lamp. On the other hand, with the lamp post cover 5 inserted into the mounting part 12, and the interference fit between the lamp post cover 5 and the mounting part 12, a secured connection between the lamp post cover 5 and the mounting part 12 is realized.

A clamping part 613 is provided in a middle part of the second surface 61 which is convenient for holding by human hand or clamping by robot hand. The first through-hole 611 and the second through-hole 612 are respectively provided on two sides of the clamping part 613. A second accommodating space 63 that can be filled with glue 8 is formed between an outer side wall of the clamping part 613 and the inner side wall of the mounting part 12, thereby not only enabling more secured connection, but also making it more difficult for the lampshade 1 and the lamp cap 2 to separate from each other under the action of external force during assembly of the lamp, thus effectively improving the waterproof level of the lamp.

By adopting the above technical solutions, the lamp of the present invention has the following beneficial effects: With the interference fit between the mounting part 12 and the lamp post cover 5, the lamp post 6, which is installed with the third electronic component 73, the PCB board 3, the LED 4, part of the first electronic component 71 and part of the second electronic component 72, is installed in the first accommodating space 53 of the lamp post cover 5. At the same time, the interference fit between the lamp post 6 and the lamp post cover 5 enables the third electronic component 73, the PCB board 3 and the LED 4 to be enclosed between the lamp post cover 5 and the lamp post 6, which effectively improves the waterproof level of the lamp. Meanwhile, the lamp installed with the lamp post cover 5 meets the UL standard; when the lampshade 1 shatters, the lamp post cover 5 will cover the third electronic component 73, the PCB board 3, the LED 4, part of the first electronic component 71 and part of the second electronic component 72, thereby preventing the human body from directly touching the power supply part, thus fulfilling certification and testing requirements for UL standard. By filling the accommodating space with glue 8, the lamp post 6 and the mounting part 12 are not easily separated from each other under the action of external force, which further effectively improves the waterproof level of the lamp.

Although the embodiments of the present invention have been presented and described, the persons skilled in the art can understand that various changes, modifications, replacements and transformations can be made to these embodiments without departing from the principle and spirit of the present invention. The scope of the present invention is defined by the appended claims and their equivalents.

What is claimed is:

1. An LED lamp comprising a lampshade, a lamp cap connected with the lampshade, and a light source device and electronic components located in the lampshade and electrically connected to each other; the lampshade comprises a cover body and a mounting part integrally connected to the cover body; the mounting part is inserted into the lamp cap, wherein a lamp post cover is provided in the mounting part with interference fit; the lamp post cover has an opening at a first end thereof which is close to the lamp cap; a lamp post is provided at the opening with interference fit; the electronic components are installed on the lamp post, and the light source device is installed between the lamp post and the lamp post cover;

the lamp post comprises a surface and an annular side wall standing on the surface; the annular side wall and the surface enclose a frame with one side open; the annular side wall of the lamp post has an outer diameter which gradually decreases from a first end thereof where the annular side wall is connected with the surface to a second end thereof; the outer diameter of the annular side wall at the first end thereof where the annular side wall is connected with the surface is larger than an outer diameter of the opening of the lamp post cover; a clamping part is provided in a middle part of the surface of the lamp post;

the lamp post is pressed into the opening of the lamp post cover to form a seal between the lamp post and the lamp post cover.

2. The LED lamp as in claim 1, wherein the lamp post is provided with through-holes for the electronic components to pass through, and the through-holes penetrate from a first side of the lamp post to a second side of the lamp post; the through-holes are respectively provided on two sides of the clamping part.

3. The LED lamp as in claim 1, wherein the lamp post cover has an outer diameter which gradually decreases from the first end thereof which is close to the lamp cap to a second end thereof which is away from the lamp cap.

4. The LED lamp as in claim 1, wherein the lamp post cover is a light-transmitting lamp post cover, and the lampshade is a light-transmitting lampshade.

5. The LED lamp as in claim 4, wherein the lamp post cover is made of PC material, and the lampshade is made of ordinary transparent plastic material.

6. The LED lamp as in claim 1, wherein the light source device comprises a PCB board; the PCB board is installed between the lamp post and the lamp post cover, and at least one LED is pasted or welded on a side of the PCB board which faces the cover body.

* * * * *